US011559120B2

(12) United States Patent
Liu

(10) Patent No.: US 11,559,120 B2
(45) Date of Patent: Jan. 24, 2023

(54) RING STRUCTURE WITH ADJUSTABLE SIZE

(71) Applicant: RockRocket Co., Ltd., New Taipei (TW)

(72) Inventor: Yung-Hao Liu, New Taipei (TW)

(73) Assignee: ROCKROCKET CO., LTD., New Taipei (TW)

( * ) Notice: Subject to any disclaimer, the term of this patent is extended or adjusted under 35 U.S.C. 154(b) by 32 days.

(21) Appl. No.: 17/202,074

(22) Filed: Mar. 15, 2021

(65) Prior Publication Data

US 2022/0287420 A1 Sep. 15, 2022

(51) Int. Cl.
*A44C 9/02* (2006.01)

(52) U.S. Cl.
CPC ..... *A44C 9/02* (2013.01)

(58) Field of Classification Search
CPC ..... A44C 9/02
See application file for complete search history.

(56) References Cited

U.S. PATENT DOCUMENTS

| | | | | |
|---|---|---|---|---|
| 2,055,315 A * | 9/1936 | Sessa | A44C 9/02 63/15 |
| 3,460,356 A * | 8/1969 | Lodrini | A44C 9/02 63/15.6 |
| 7,226,370 B1 * | 6/2007 | Cope | A63B 57/207 473/406 |
| 2004/0134228 A1 * | 7/2004 | Sills | A44C 9/02 63/15.5 |

* cited by examiner

*Primary Examiner* — Jack W Lavinder
(74) *Attorney, Agent, or Firm* — Chun-Ming Shih; HDLS IPR Services

(57) ABSTRACT

The disclosure relates to a ring structure with an adjustable size, which includes an outer ring, an inner ring, and a concave-convex structure. The outer ring has an inner wall. The inner ring is removably fitted inside the outer ring and has an outer wall abutting against the inner wall. The concave-convex structure includes a protrusion connected on either one of the inner wall of the outer ring and the outer wall of the inner ring and a slot disposed on another one of the inner wall of the outer ring and the outer wall of the inner ring. The protrusion is mortised in the slot. Therefore, the inner ring is removably fitted inside the outer ring to generate a ring with various sizes for different users. The ring structure of this disclosure may have the advantages of providing various sizes and saving costs.

9 Claims, 5 Drawing Sheets

RING STRUCTURE WITH ADJUSTABLE SIZE

BACKGROUND OF THE DISCLOSURE

Technical Field

The disclosure relates to a ring structure, particularly to a ring structure with an adjustable size.

Related Art

Rings can represent a unique style of fingers, so rings become one of the popular adornments in the market. However, sizes of rings are fixed, so the rings cannot be worn on fingers with different width. The finger and the ring may not be matched for different wearers or with the changes of wearer's body, such as becoming fatter or slimmer.

To solve the above problem, the provider usually produces a ring of the same shape with different diameters. However, the cost is increased. Otherwise, rings are formed into a C-shape with flexible material to make the sizes flexible for the wearer to nip and press the rings to be fitting with the finger width. However, that may make the rings be deformed or distorted.

In view of this, the inventors have devoted themselves to the above-mentioned related art, researched intensively and cooperated with the application of science to try to solve the above-mentioned problems. Finally, the disclosure which is reasonable and effective to overcome the above drawbacks is provided.

SUMMARY OF THE DISCLOSURE

The disclosure provides a ring structure with an adjustable size, which uses an inner ring removably fitted inside an outer ring to generate a ring with various diameters for the user to choose. The object of the ring structure having the advantages of providing various sizes and saving costs is achieved.

In an embodiment of the disclosure, the disclosure provides a ring structure with an adjustable size, which includes an outer ring, an inner ring, and a concave-convex structure. The outer ring has an inner wall. The inner ring is removably fitted inside the outer ring and has an outer wall abutting against the inner wall. The concave-convex structure includes a protrusion connected on either one of the inner wall of the outer ring and the outer wall of the inner ring and a slot disposed on another one of the inner wall of the outer ring and the outer wall of the inner ring. The protrusion is mortised in the slot.

Accordingly, when a wearer has thicker finger or becomes fatter, the wearer may directly wear the outer ring. When the wearer has thinner finger or becomes slimmer, the wearer may put the inner ring in the outer ring and then wear the inner ring fitted in the outer ring. This may reduce the diameter inside the outer ring to make the ring structure have various diameters, such as a diameter of the outer ring and a diameter of the inner ring, for the user to choose. Thus, the ring structure of this disclosure may have the advantages of providing various sizes and saving costs.

Accordingly, the inner wall of the outer ring and the outer wall of the inner ring are mortised with each other by a protrusion and a slot to make the inner ring be firmly fitted inside the outer ring. The assembling stability and structural strength of the ring structure are enhanced.

DETAILED DESCRIPTION OF THE DISCLOSURE

Figure 1:
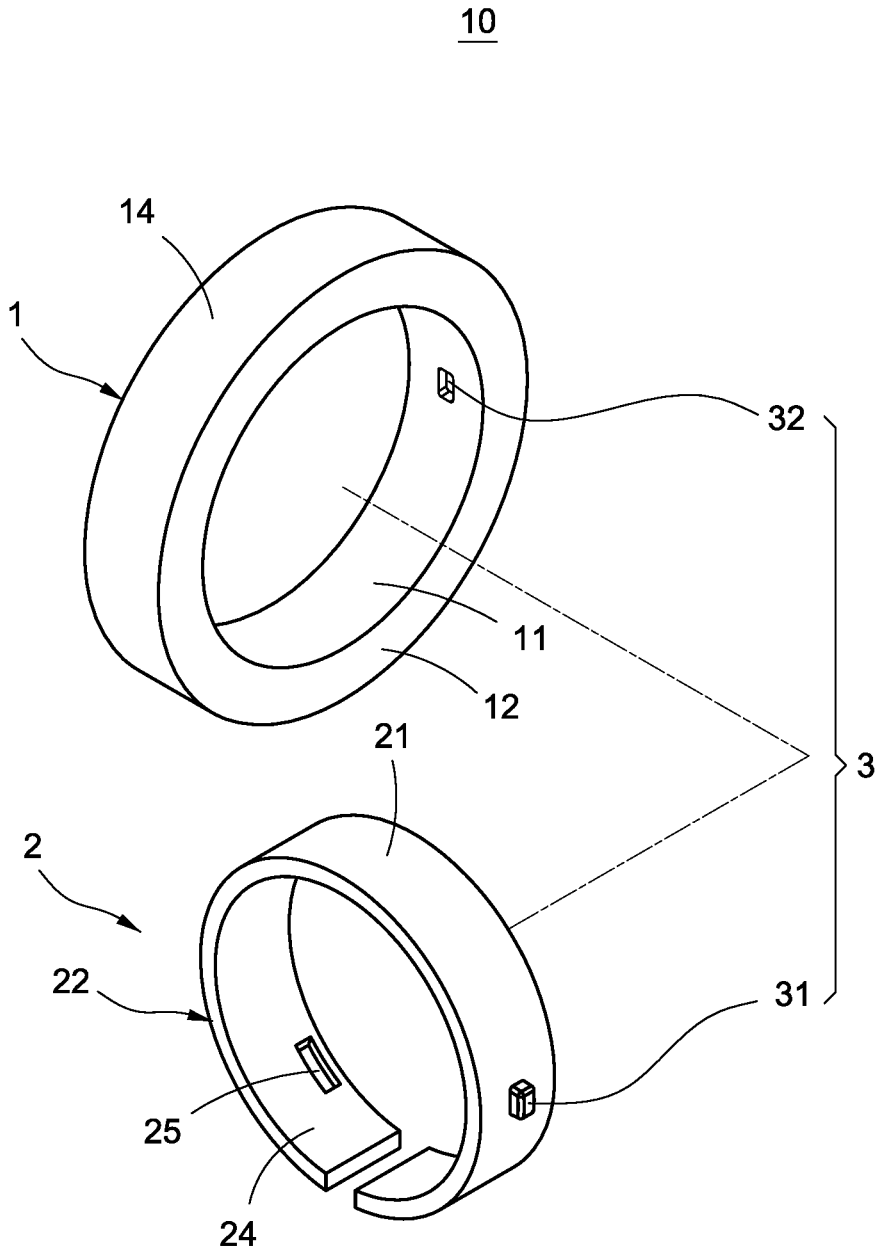
FIG. 1 is an exploded view of the ring structure of the disclosure.
Figure 2:
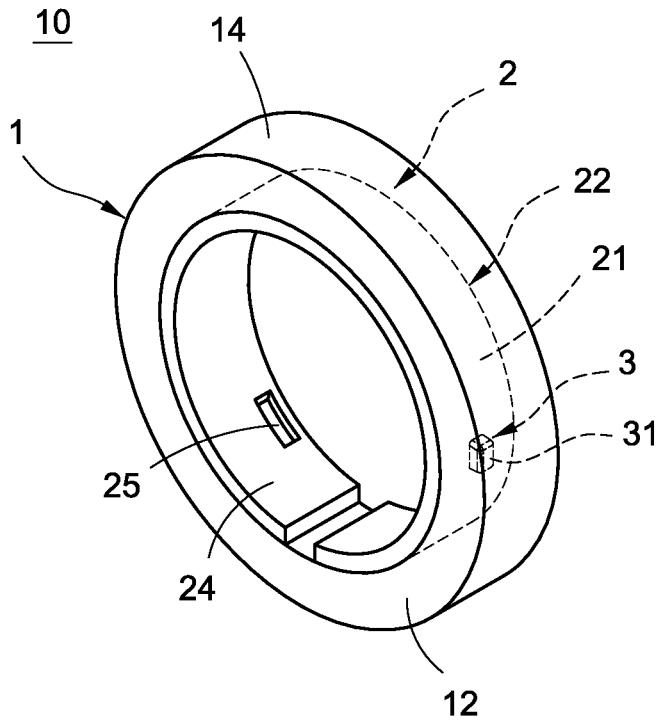
FIG. 2 is an assembled view of the ring structure of the disclosure.
Figure 3:
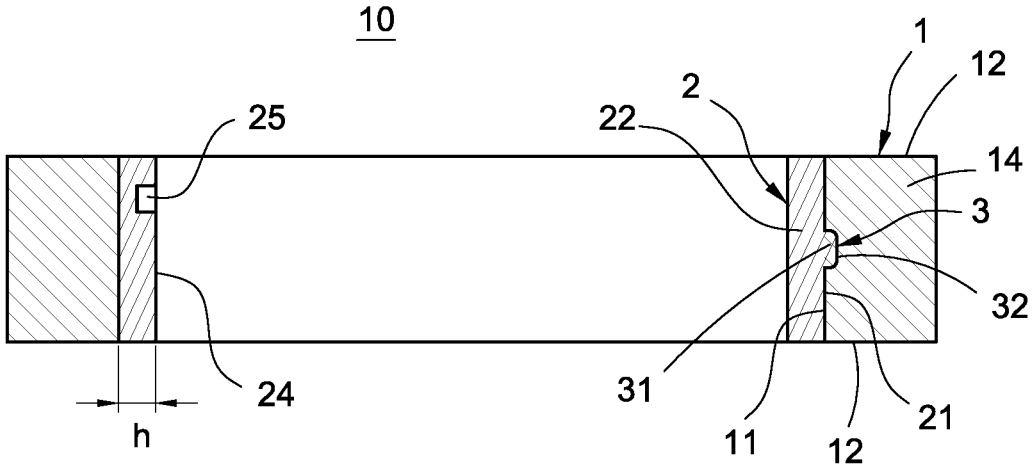
FIG. 3 is a cross-sectional view of the ring structure of the disclosure.
Figure 4:
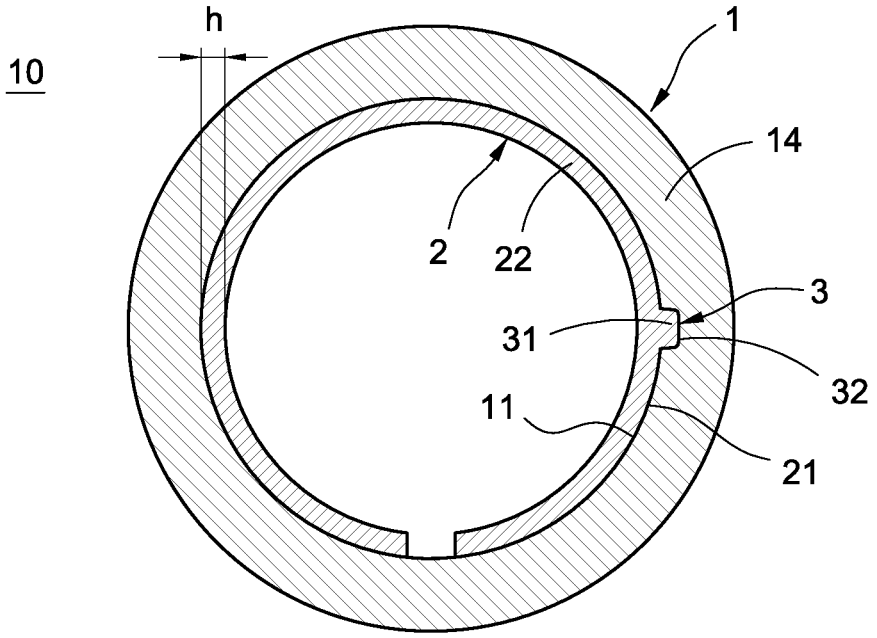
FIG. 4 is another cross-sectional view of the ring structure of the disclosure.

To further disclose the features and technical contents of the disclosure, please refer to the following description and the drawings. However, the drawings are used for reference and description only, not for limitation to the disclosure.

Please refer to FIGS. 1-4. The disclosure provides a ring structure 10 with an adjustable size, which includes an outer ring 1, an inner ring 2 and a concave-convex structure 3.

The outer ring 1 has an inner wall 11 and two sidewalls 12 disposed on a top side and a bottom side of the inner wall 11. In the embodiment, the outer ring 1 is, but not limited to, an annular body 14.

The inner ring 2 is removably fitted inside the outer ring 1. That is, the inner ring 2 is put inside the outer ring 1, and the inner ring 2 may be removed from the outer ring 1. The inner ring 2 has an outer wall 21 abutting against the inner wall 11 of the outer ring 1. The inner ring 2 has an inner side 24 opposite to the outer wall 21. The inner side 24 is formed with a recess 25 inwardly.

In the embodiment, the inner ring 2 is a C-shaped ring 22, which may be forcedly or non-forcedly fitted inside the annular body 14.

The concave-convex structure 3 includes a protrusion 31 connected on either one of the inner wall 11 of the outer ring 1 and the outer wall 21 of the inner ring 11 and a slot 32 disposed on the other one of the inner wall 11 of the outer ring 1 and the outer wall 21 of the inner ring 2. The protrusion 31 is mortised in the slot 32.

In detail, in the embodiment, the protrusion 31 is connected on the outer wall 21 of the inner ring 2, and the slot 32 is disposed on the inner wall 11 of the outer ring 1, but not limited to this. The protrusion 31 may also be connected on the inner wall 11 of the outer ring 1 and the slot 32 may be disposed on the outer wall 21 of the inner ring 2.

Additionally, the C-shaped ring 22 may be elastically deformed by its opening, so that the C-shaped ring 22 is forcedly put inside the annular body 14. The material of the protrusion 31 may be, but not limited to, rubber, silicone, plastic, or metal, etc. The protrusion 31 is mortised in the slot 32 in a manner of concave-convex engagement.

When the C-shaped ring 22 is non-forcedly connected inside the annular body 14, the protrusion 31 may be made of flexible material such as rubber, silicone, or plastic, etc.

The outer size of the protrusion 31 is slightly greater than the inner size of the slot 32 so that the protrusion 31 is tightly mortised in the slot 32.

As shown in FIGS. 1-4 for the using state of the ring structure 10, when the wearer has thicker finger or becomes fatter, the wearer may directly wear the outer ring 1. When the wearer has thinner finger or becomes slimmer, the wearer may put the inner ring 2 in the outer ring 1 and then wear the inner ring 2 fitted in the outer ring 1. This may reduce an inner diameter of the outer ring 1 to make the ring structure 1 have various sizes, such as a diameter of the outer ring 1 and a diameter of the inner ring 2, for the users to choose. That is, the object of the ring structure 10 having the advantages of providing various sizes and saving costs are achieved.

In addition, the C-shaped ring 22 may be slightly elastically deformed by its opening to fit a shape of the user's finger to reduce wearing pressure. Also, the outer ring 1 uniformly constraint the C-shaped ring 22 to prevent the C-shaped ring 22 from deforming. This makes the ring structure 10 have the effects of comfortable wearing and the ring being hard to be deformed and damaged.

Moreover, the inner wall 11 of the outer ring 1 and the outer wall 21 of the inner ring 2 are engaged (or mortised) by the protrusion 31 and the slot 32 to make the inner ring 2 firmly fitted in the outer ring 1. This may improve assembling stability and structural strength of the ring structure 10.

Also, the inner side 24 of the inner ring 2 is formed with a recess 25 inwardly. A user may move (or stir) the inner ring 2 through the recess 25 to remove the inner ring 2 from the outer ring 1.

Figure 5:
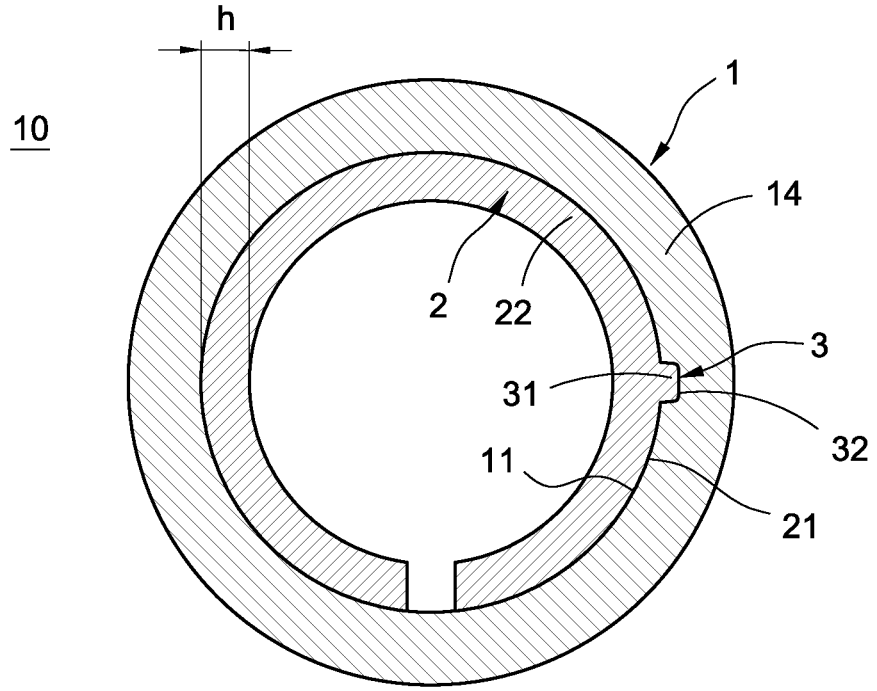
FIG. 5 is a cross-sectional view of another embodiment of the ring structure of the disclosure.

Please refer to FIG. 5, which shows another embodiment of the ring structure 10 of the disclosure. The embodiment in FIG. 5 is similar to the embodiment in FIGS. 1-4. The embodiment shown in FIG. 5 differs from the above embodiment by changing the number of the inner rings 2 to multiple. The thicknesses h of the inner rings 2 are different from each other. One of the inner rings 2 may be selected to be fitted in the outer ring 1. As a result, the ring structure 10 has various sizes, such as the diameter of the outer ring 1 and the diameters of the multiple inner rings 2, for the users to choose. The same function as the embodiment shown in FIGS. 1-4 is achieved.

Figure 6:
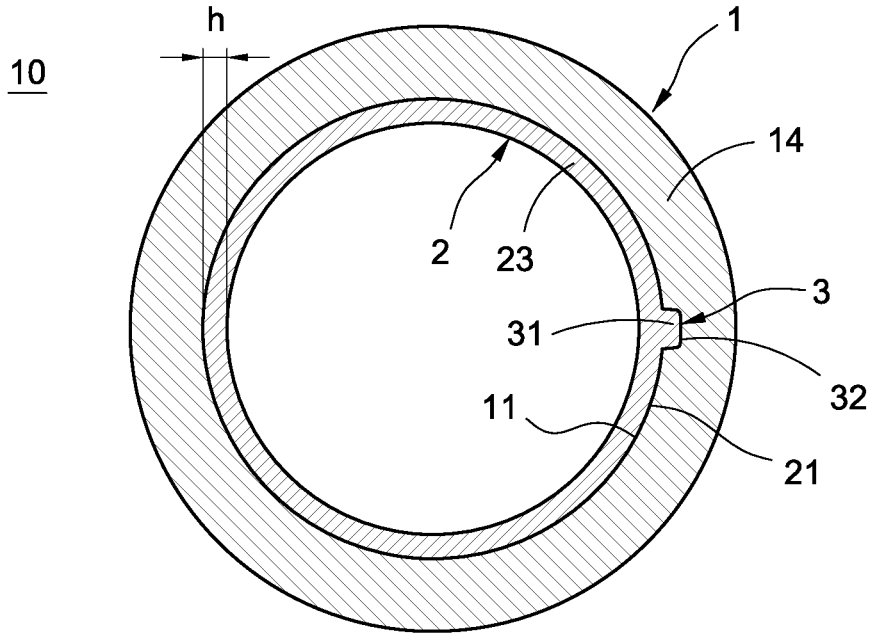
FIG. 6 is a cross-sectional view of still another embodiment of the ring structure of the disclosure.

Please refer to FIG. 6, which shows still another embodiment of the disclosure. The embodiment shown in FIG. 6 is similar to the embodiment shown in FIGS. 1-4. The embodiment shown in FIG. 6 differs from the embodiment shown in FIGS. 1-4 by embodying the inner ring 2 with a circular ring 23.

In detail, in this embodiment, the inner ring 2 is a circular ring 23. The circular ring 23 is non-forcedly fitted inside the annular body 14, so the protrusion 31 is made of a flexible material such as rubber, silicone, or plastic, etc. The outer size of the protrusion 31 is slightly greater than the inner size of the slot 32 so that the protrusion 31 may be tightly mortised in the slot 32. As a result, the inner ring 2 is firmly fitted in the outer ring 1 to accomplish the same function as the embodiment shown in FIGS. 1-4.

Figure 7:
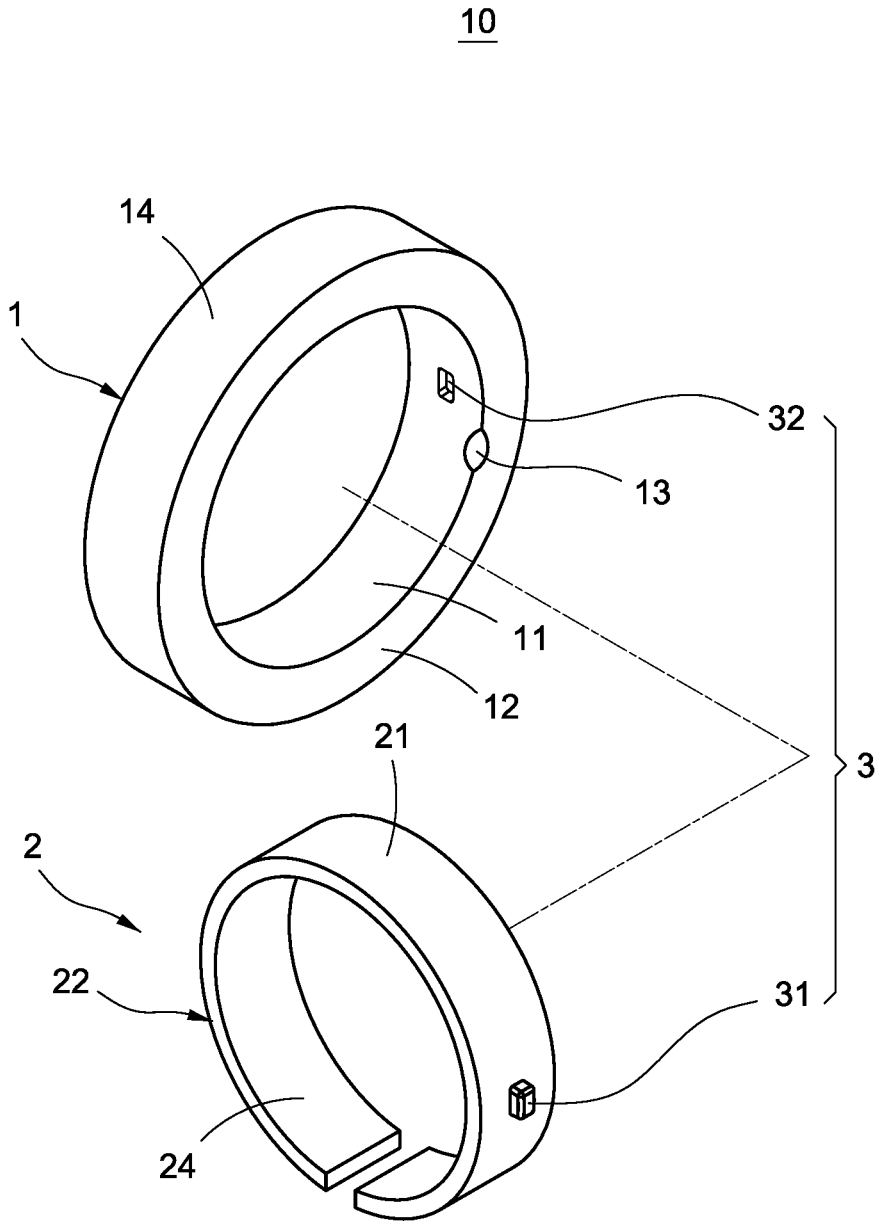
FIG. 7 is a cross-sectional view of yet another embodiment of the ring structure of the disclosure.

Please refer to FIG. 7, which shows yet another embodiment of the disclosure. The embodiment shown in FIG. 7 is similar to the embodiment shown in FIGS. 1-4. The embodiment shown in FIG. 7 differs from the embodiment shown in FIGS. 1-4 by the outer ring 1 having a notch 13 carved inwardly from the inner wall 11 and one of the sidewalls 12 thereof.

In detail, the outer ring 1 is formed with a notch 13 on the inner wall 11 and one of the sidewalls 12 collectively. When the inner ring 2 is fitted in the outer ring 1, the notch 13 is located on a side of the inner ring 2. The wearer's finger may move (or stir) the inner ring 2 through the notch 13 so as to easily remove the inner ring 2 from the outer ring 1.

It will be appreciated by persons skilled in the art that the above embodiments have been described by way of example only and not in any limitative sense, and that various alterations and modifications are possible without departure from the scope of the disclosure as defined by the appended claims.

What is claimed is:

1. A ring structure with an adjustable size, the ring structure comprising:

an outer ring, comprising an inner wall;

an inner ring, removably fitted inside the outer ring, and comprising an outer wall abutting against the inner wall; and a concave-convex structure, comprising a protrusion connected on either one of the inner wall of the outer ring and the outer wall of the inner ring and a slot disposed on another one of the inner wall of the outer ring and the outer wall of the inner ring, and the protrusion mortised in the slot, wherein the inner ring comprises an inner side, and an indentation is formed on the inner side for a user to remove the inner ring from the outer ring.

2. The ring structure of claim 1, wherein the outer ring comprises two sidewalls disposed on a top side and a bottom side of the inner wall, and a notch is disposed on the outer ring and carved inwardly from the inner wall and one of the sidewalls.

3. The ring structure of claim 1, wherein the outer ring comprises an annular body.

4. The ring structure of claim 3, wherein the inner ring comprises a circular ring.

5. The ring structure of claim 3, wherein the inner ring comprises a C-shaped ring.

6. The ring structure of claim 5, wherein the C-shaped ring is forcedly fitted inside the annular body.

7. The ring structure of claim 1, wherein the protrusion comprises a flexible material, and the protrusion is forcedly mortised in the slot.

8. The ring structure of claim 7, wherein the protrusion comprises a material of a rubber, a silicone, or a plastic.

9. The ring structure of claim 1, wherein a number of the inner ring is multiple, thicknesses of the inner rings are different with each other, and one of the inner rings is fitted inside the outer ring.

* * * * *